US012440026B2

(12) United States Patent
Chen et al.

(10) Patent No.: US 12,440,026 B2
(45) Date of Patent: Oct. 14, 2025

(54) SLIDE RAIL KIT

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Chiang-Hsueh Fang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 125 days.

(21) Appl. No.: 18/506,714

(22) Filed: Nov. 10, 2023

(65) Prior Publication Data

US 2025/0017372 A1 Jan. 16, 2025

(30) Foreign Application Priority Data

Jul. 11, 2023 (TW) ..... 112126126

(51) Int. Cl.
*A47B 88/49* (2017.01)

(52) U.S. Cl.
CPC ..... *A47B 88/49* (2017.01)

(58) Field of Classification Search
CPC .... A47B 2210/0016; A47B 2210/0018; A47B 88/40; A47B 88/49; A47B 88/403; A47B 88/447
USPC ... 312/334.1, 334.44, 334.46, 334.47, 334.7, 312/333; 211/26
See application file for complete search history.

(56) References Cited

U.S. PATENT DOCUMENTS

| | | | | |
|---|---|---|---|---|
| 4,549,773 | A * | 10/1985 | Papp | A47B 88/493 312/334.47 |
| 10,231,540 | B1 | 3/2019 | Hong | |
| 10,334,950 | B2 * | 7/2019 | Chen | A47B 88/443 |
| 2003/0080659 | A1 * | 5/2003 | Judge | A47B 88/493 312/334.47 |
| 2006/0029304 | A1 * | 2/2006 | Chen | A47B 88/493 384/18 |
| 2010/0259146 | A1 * | 10/2010 | Chen | A47B 88/493 312/319.1 |
| 2017/0082143 | A1 * | 3/2017 | Chen | F16C 29/12 |
| 2018/0317652 | A1 * | 11/2018 | Chen | A47B 88/49 |

* cited by examiner

*Primary Examiner* — Cassandra Davis
(74) *Attorney, Agent, or Firm* — Best & Flanagan LLP

(57) ABSTRACT

A slide rail kit includes a first rail, a second rail, an elastic member and an engaging member. The first rail is arranged with an engaging feature. The engaging member is movably mounted on the second rail. When the second rail is located at a retracted position relative to the first rail, the engaging member is configured to be engaged with the engaging feature of the first rail. When a force is applied to the engaging member to switch the engaging member from an engaging state to a disengaging state, the second rail is movable relative to the first rail from the retracted position along a predetermined direction.

19 Claims, 11 Drawing Sheets

SLIDE RAIL KIT

BACKGROUND OF THE INVENTION

1. Field of the Invention

The present invention relates to a slide rail, and more particularly, to a slide rail kit having two slide rails with a locking function when being retracted relative to each other.

2. Description of the Prior Art

U.S. Pat. No. 10,231,540 B1 discloses a slide device with locking function, which comprises a fixed rail, a first movable rail and a second movable rail. The first movable rail is movably mounted between the fixed rail and the second movable rail. The second movable rail can be locked to a locking unit of the fixed rail through a locked member, so as to achieve the effect of locking the second movable rail when being retracted. The locking unit of the fixed rail has a guide portion in an arc shape. The locked member comprises a release lever connection portion and a stopped portion. The release lever connection portion has a horizontal bending part and a downward bending part. The locked member is elastically supported by a spring. The spring is bent from back to front, and the spring has a hook portion which is formed by horizontally bending a front end of the spring and then downwardly vertically bending the front end.

The aforementioned patent discloses two slide rails with a locking function relative to each other. However, in order to meet diverse requirements of the market, it is important to develop various slide rail products.

SUMMARY OF THE INVENTION

The present invention provides a slide rail kit having two slide rails with a locking function when being retracted relative to each other.

According to an embodiment of the present invention, a slide rail kit comprises a first rail, a second rail, an elastic member and an engaging member. The first rail is arranged with an engaging feature. The second rail is movable relative to the first rail. The engaging member is movably mounted on the second rail and adjacent to a front end of the second rail. The engaging member is configured to be held in an engaging state in response to an elastic force of the elastic member. When the second rail is located at a retracted position relative to the first rail, the engaging member is configured to be engaged with the engaging feature of the first rail, in order to lock the second rail at the retracted position relative to the first rail. When a force is applied to the engaging member to overcome the elastic force of the elastic member, the engaging member is configured to be moved to switch from the engaging state to a disengaging state, in order to allow the second rail to move relative to the first rail from the retracted position along an opening direction.

According to another embodiment of the present invention, a slide rail kit comprises a first rail, a second rail, an elastic member and an engaging member. The first rail is arranged with an engaging feature. The second rail is movable relative to the first rail. The engaging member is movably mounted on the second rail. The engaging member is configured to be held in an engaging state in response to an elastic force of the elastic member. When the second rail is located at a retracted position relative to the first rail, the engaging member is configured to be engaged with the engaging feature of the first rail, in order to lock the second rail at the retracted position relative to the first rail. The engaging member comprises an operating part. The second rail is arranged with a handle. When a force is applied to the operating part, the engaging member is configured to be moved to switch from the engaging state to a disengaging state, in order to disengage the engaging member from the engaging feature of the first rail, and when another force is further applied to the handle along an opening direction, the second rail is configured to be moved relative to the first rail from the retracted position along the opening direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
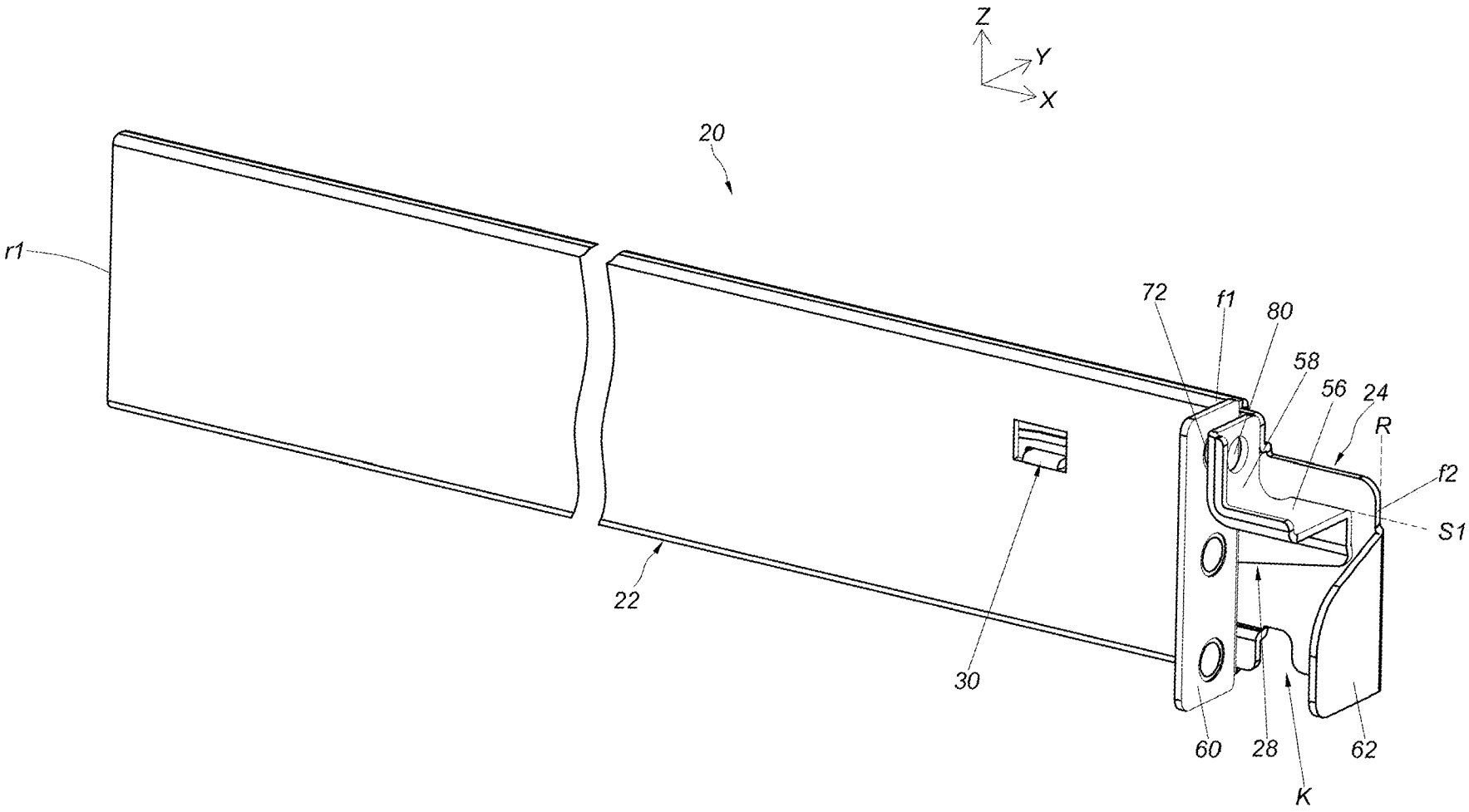
FIG. 1 is a diagram showing a slide rail kit according to an embodiment of the present invention.
Figure 2:
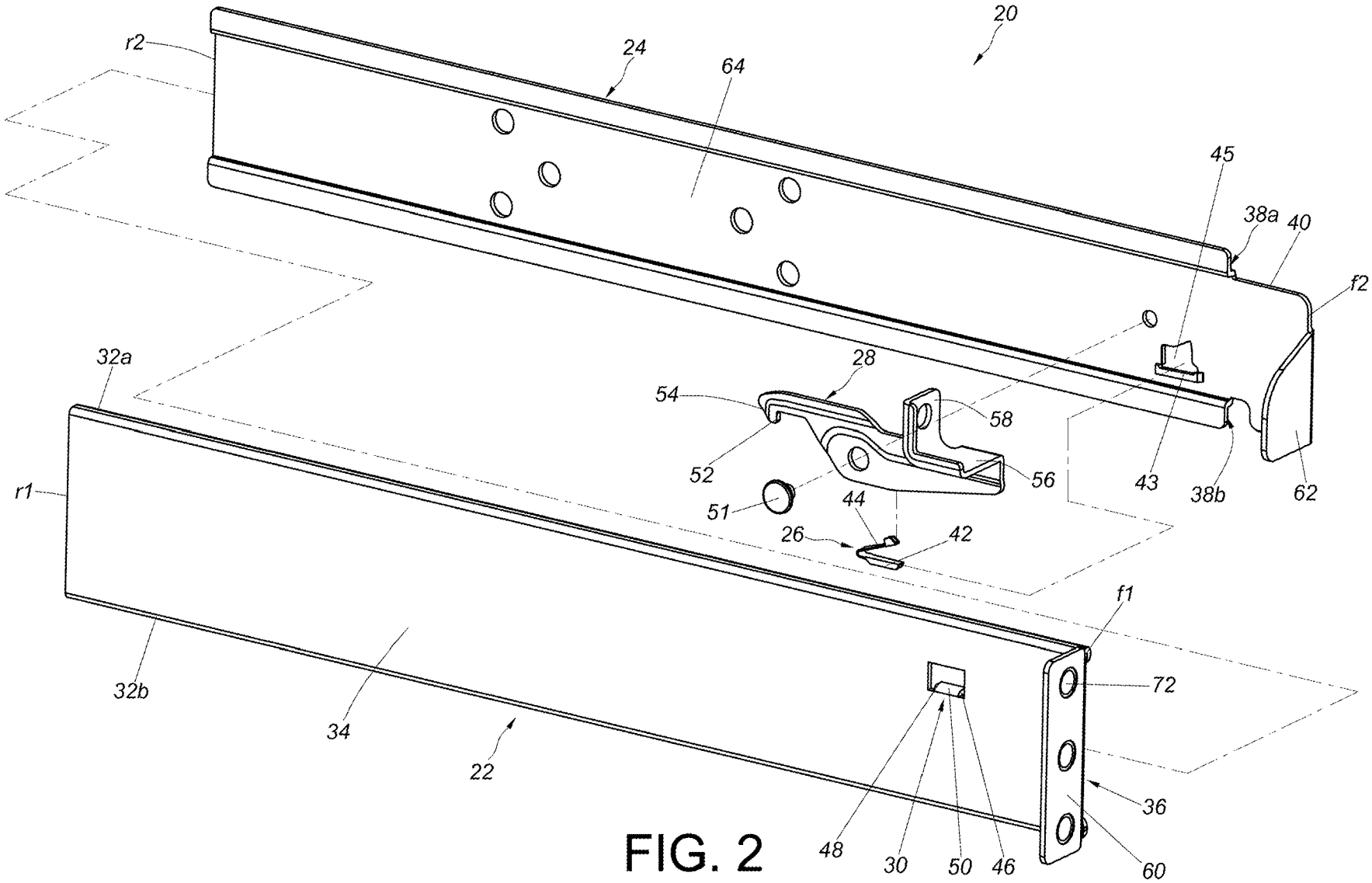
FIG. 2 is an exploded view of the slide rail kit according to the embodiment of the present invention.
Figure 3:
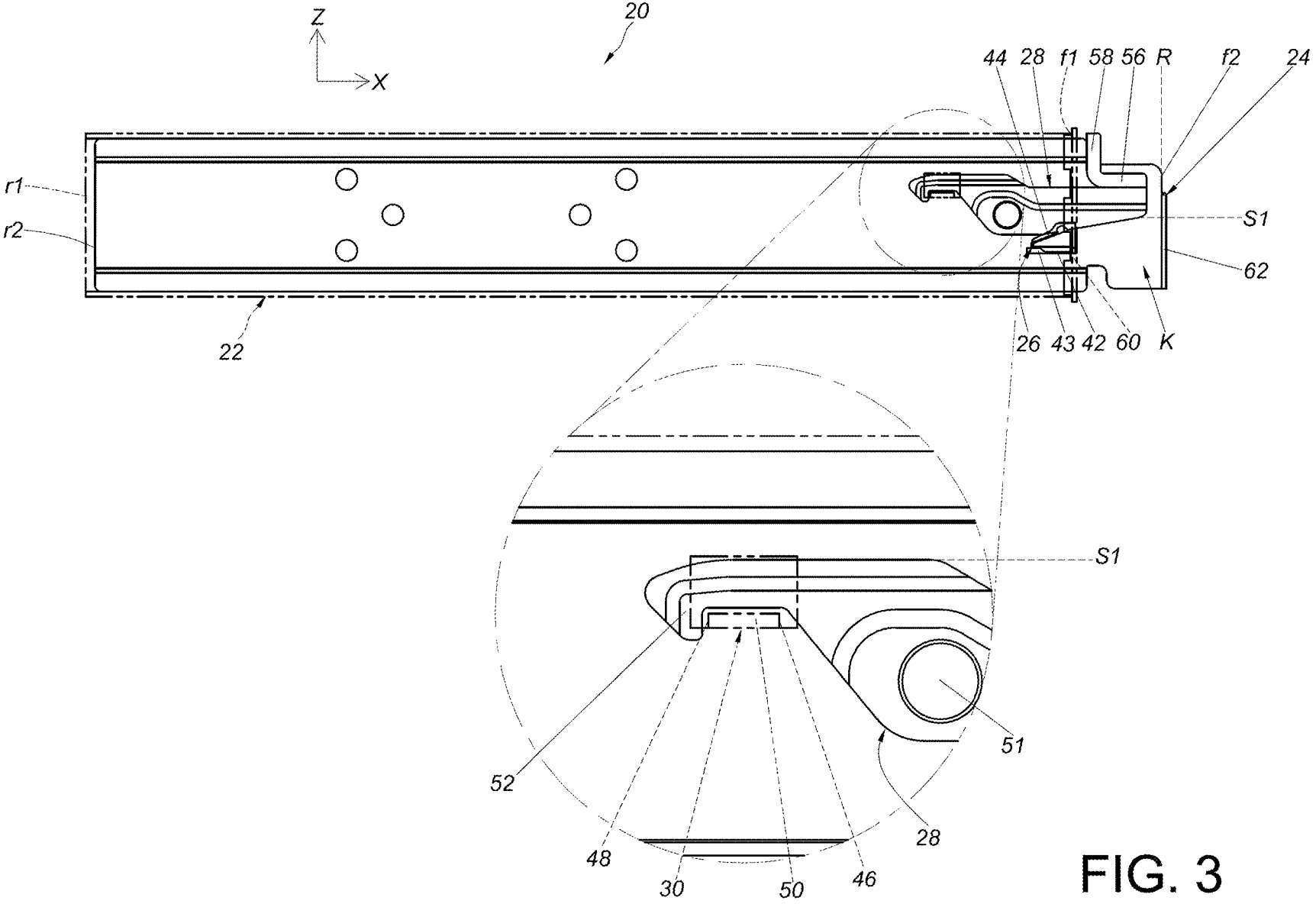
FIG. 3 is a diagram showing a second rail of the slide rail kit being locked at a retracted position relative to a first rail by an engaging member according to the embodiment of the present invention.

As shown in FIG. 1 to FIG. 3, a slide rail kit 20 comprises a first rail 22, a second rail 24, an elastic member 26 and an engaging member 28 according to an embodiment of the present invention. The second rail 24 is longitudinally movable relative to the first rail 22. In FIG. 1, the X axis is a longitudinal direction (or a length direction of the slide rail), the Y axis is a transverse direction (or a lateral direction of the slide rail), and the Z axis is a vertical direction (or a height direction of the slide rail).

The first rail 22 is arranged with an engaging feature 30. The first rail 22 has a front end f1 and a rear end r1. Preferably, the first rail 22 comprises a first wall 32*a*, a second wall 32*b* and a middle wall 34 connected between the first wall 32*a* and the second wall 32*b* of the first rail 22, and a passage 36 is defined by the first wall 32*a*, the second wall 32*b* and the middle wall 34, and configured to movably mount the second rail 24. For example, the passage 36 is configured to accommodate the second rail 24 (please also refer to FIG. 9).

Preferably, the engaging feature 30 is located inside the passage 36 of the first rail 22.

The second rail 24 has a front end f2 and a rear end r2. Preferably, the second rail 24 comprises a first wall 38*a*, a second wall 38*b* and a middle wall 40 connected between the first wall 38*a* and the second wall 38*b* of the second rail 24. The elastic member 26 is arranged on the middle wall 40 of the second rail 24. The second rail 24 is configured to carry a carried object (such as a chassis or a drawer).

Preferably, the elastic member 26 is a V-shaped elastic piece. The elastic member 26 comprises a first elastic arm 42 abutting against a predetermined mounting part 43 of the middle wall 40 of the second rail 24, and a second elastic arm 44 configured to support the engaging member 28. In the present embodiment, the middle wall 40 of the second rail 24 has an opening 45 (as shown in FIG. 2). The elastic member 26 is configured to be mounted inside the opening 45, so as to reduce space occupied by the elastic member 26 at both sides of the second rail 24. The predetermined mounting part 43 is arranged in the opening 45 and configured to support the elastic member 26 (the first elastic arm 42 of the elastic member 26).

Preferably, the engaging feature 30 comprises a first vertical wall 46, a second vertical wall 48 and a middle part 50 connected between the first vertical wall 46 and the second vertical wall 48.

The engaging member 28 is movably mounted on the second rail 24 and adjacent to the front end f2 of the second rail 24. The engaging member 28 is configured to be held in an engaging state S1 in response to an elastic force of the elastic member 26.

Preferably, the engaging member 28 is movably mounted on the middle wall 40 of the second rail 24. In the present embodiment, the engaging member 28 is pivotally connected to the middle wall 40 of the second rail 24 through a shaft member 51, but the present invention is not limited thereto.

Preferably, the engaging member 28 comprises an engaging part 52 and a guiding part 54 adjacent to the engaging part 52. In the present embodiment, the engaging member 28 further comprises an operating part 56 and a connecting part 58 bent relative to the operating part 56. For example, the connecting part 58 is substantially perpendicularly connected to the operating part 56 along the height direction, but the present invention is not limited thereto. The shaft member 51 is located between the engaging part 52 and the operating part 56.

When the second rail 24 is located at a retracted position R relative to the first rail 22, the engaging member 28 (the engaging part 52 of the engaging member 28) is engaged with the engaging feature 30 (the second vertical wall 48 of the engaging feature 30) of the first rail 22, such that the second rail 24 is locked at the retracted position R relative to the first rail 22, so as to prevent the second rail 24 from being opened from the retracted position R.

Preferably, a bending part 60 is perpendicularly connected to the front end f1 of the first rail 22 and extended along a transverse direction (lateral direction). The front end f2 of the second rail 24 is arranged with a bending section, and the bending section can serve as a handle 62. For example, the handle 62 is perpendicularly connected to the front end f2 of the second rail 24 and extended along a transverse direction. An extending direction of the bending part 60 relative to the first rail 22 and an extending direction of the handle 62 relative to the second rail 24 are the same direction and the bending part 60 and the handle 62 are substantially parallel to each other. When the second rail 24 is locked at the retracted position R relative to the first rail 22, a predetermined space K is defined between the handle 62 of the second rail 24 and the bending part 60 of the first rail 22.

Figure 4:
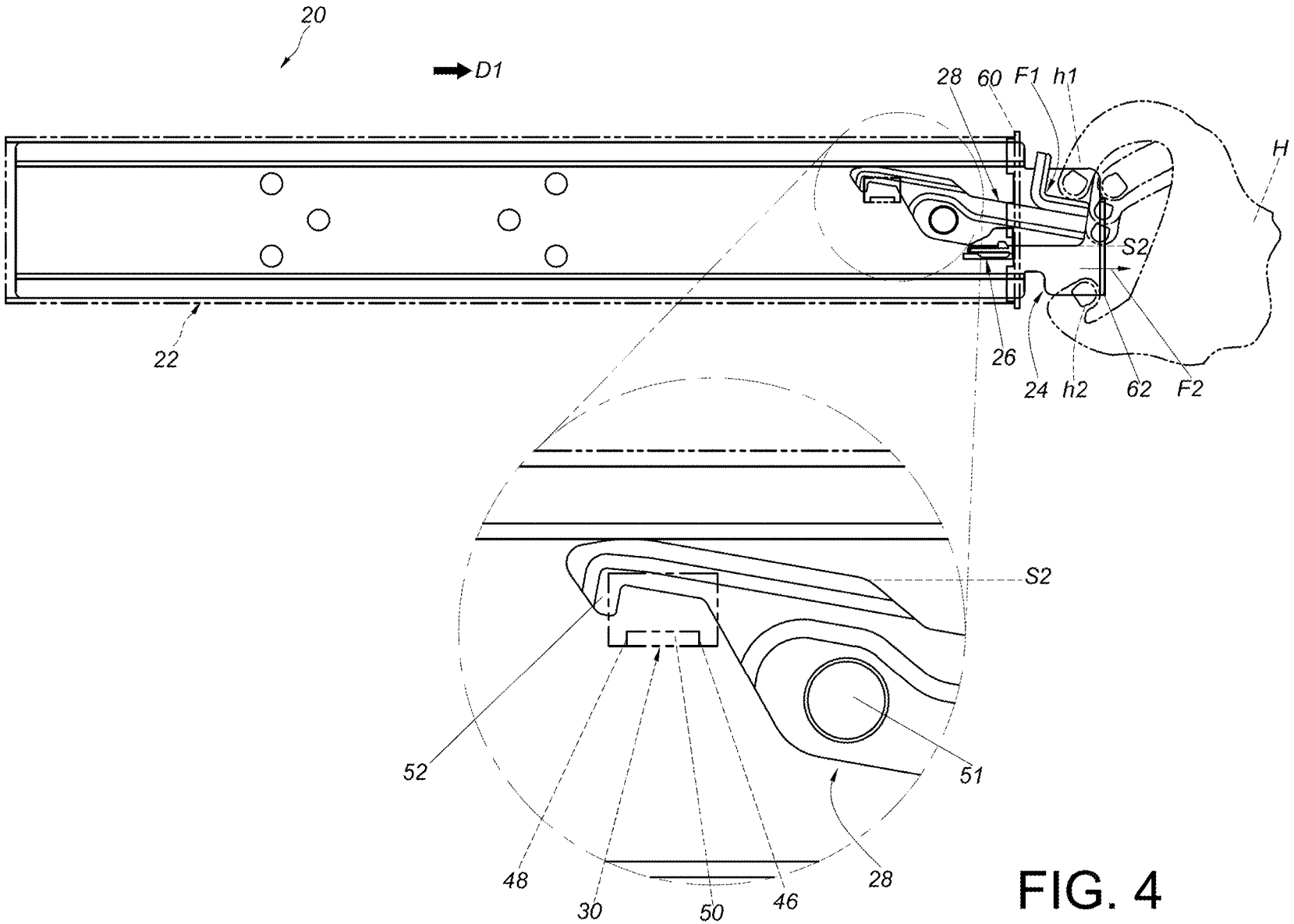
FIG. 4 is a diagram showing a first force being applied to the engaging member of the slide rail kit to disengage the engaging member from the first rail, and a second force being applied to the second rail according to the embodiment of the present invention.
Figure 5:
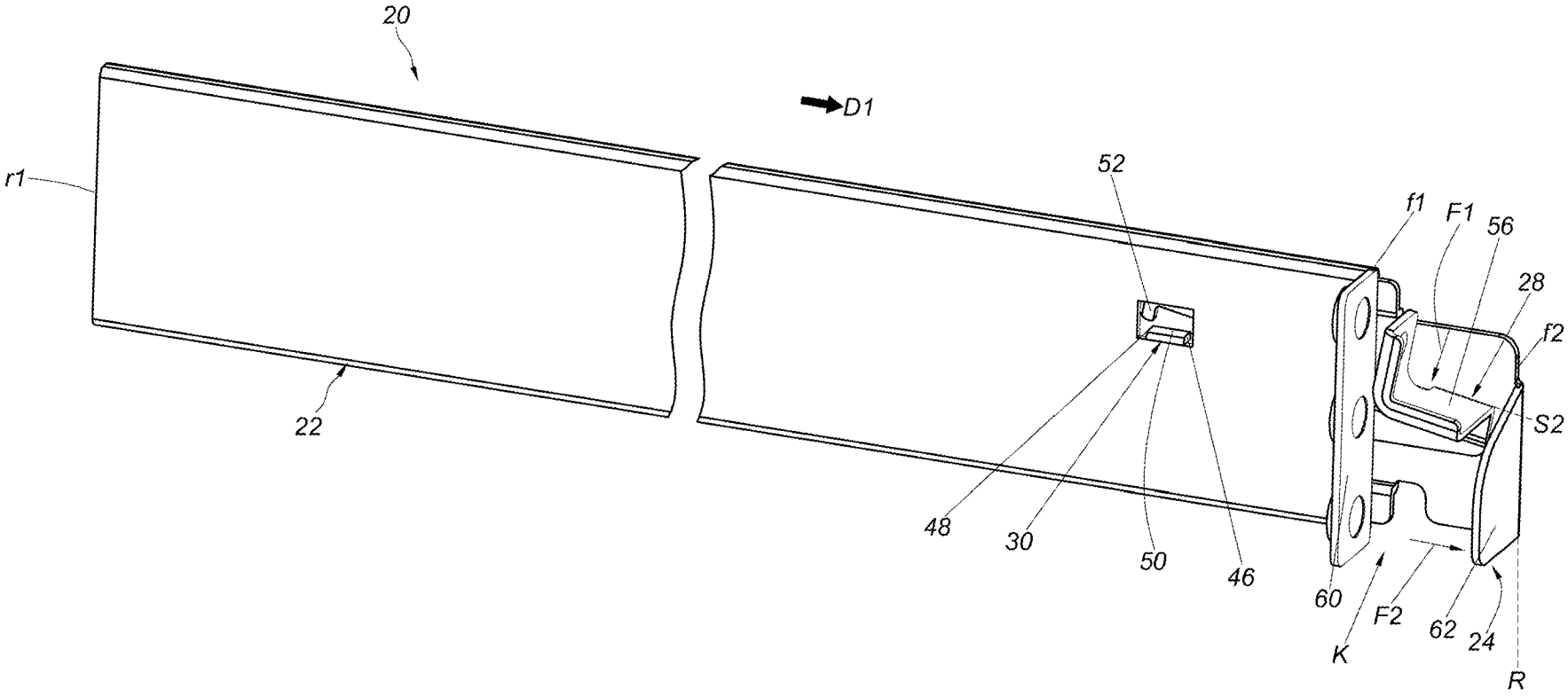
FIG. 5 is a diagram showing the first force being applied to the engaging member of the slide rail kit to disengage the engaging member from the first rail, and the second force being applied to the second rail according to the embodiment of the present invention.
Figure 6:
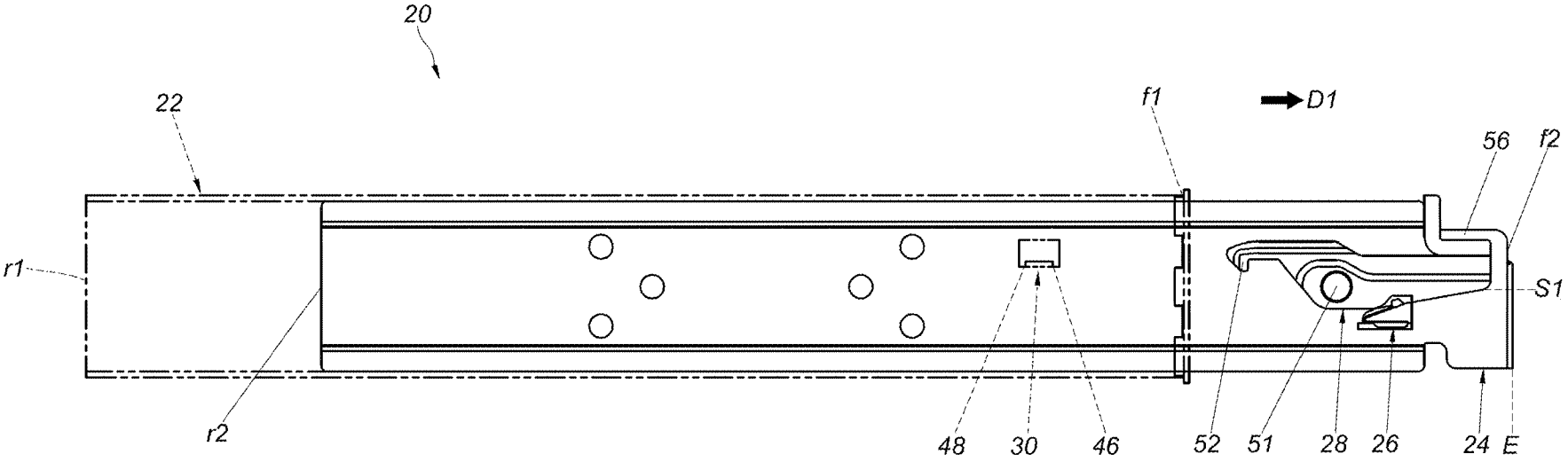
FIG. 6 is a diagram showing the second force being applied to the second rail of the slide rail kit to move the second rail relative to the first rail along an opening direction according to the embodiment of the present invention.

As shown in FIG. 3 to FIG. 6, when a force F1 is applied to the engaging member 28 to overcome the elastic force of the elastic member 26 (as shown in FIG. 4 and FIG. 5), the engaging member 28 is configured to be moved to switch from the engaging state S1 (as shown in FIG. 3) to a disengaging state S2 (as shown in FIG. 4 and FIG. 5), in order to allow the second rail 24 to move relative to the first rail 22 from the retracted position R along an opening direction D1 (as shown in FIG. 6). Furthermore, when the force F1 is applied to the operating part 56 of the engaging member 28, the engaging member 28 is configured to be moved to switch from the engaging state S1 (as shown in FIG. 3) to the disengaging state S2 (as shown in FIG. 4 and FIG. 5), and when another force F2 is further applied to the handle 62 of the second rail 24 along the opening direction D1, the second rail 24 is movable relative to the first rail 22 from the retracted position R along the opening direction D1 (as shown in FIG. 6).

For example, when a user applies the force F1 to the operating part 56 of the engaging member 28 through a first finger h1 of a hand H (as shown in FIG. 4 and FIG. 5), the engaging member 28 is configured to be moved to switch from the engaging state S1 (as shown in FIG. 3) to the disengaging state S2 (as shown in FIG. 4 and FIG. 5), such that the engaging member 28 (the engaging part 52 of the engaging member 28) is disengaged from the engaging feature 30 (the second vertical wall 48 of the engaging feature 30) of the first rail 22. In addition, the user can further use a second finger h2 of the hand H to extend into the predetermined space K and apply another force F2 along the opening direction D1 to the handle 62 of the second rail 24 (as shown in FIGS. 4 and 5), so as to move the second rail 24 relative to the first rail 22 from the retracted position R along the opening direction D1 to an extended position E (as shown in FIG. 6).

Moreover, the handle 62 can be directly or indirectly connected to the second rail 24; or the handle 62 can be an additional item connected to or detachably mounted to the second rail 24, but the present invention is not limited thereto. In addition, in the present embodiment, the front end f2 of the second rail 24 is arranged with the bending section serving as the handle 62. However, in other embodiments, the second rail 24 can be formed with an auxiliary space or an auxiliary hole. The auxiliary space or the auxiliary hole and its inner wall can replace the handle 62. For example, the auxiliary space or the auxiliary hole is configured to allow the finger of the user to extend inside, and the inner wall of the auxiliary space or the auxiliary hole is configured to allow the finger of the user to apply the other force F2 to the second rail 24. Therefore, the handle 62 of the second rail 24 is not limited to the bending section disclosed in the present embodiment.

In addition, when the force F1 is applied to the engaging member 28 to move the engaging member 28 to switch from the engaging state S1 to the disengaging state S2, the elastic member 26 is configured to accumulate an elastic force (as shown in FIG. 4). When the second rail 24 is located at the extended position E and when the user stops applying the force F1 to the engaging member 28 (the operating part 56 of the engaging member 28), the engaging member 28 is configured to return to the engaging state S1 from the disengaging state S2 (as shown in FIG. 6) in response to the elastic force released by the elastic member 26.

Figure 7:
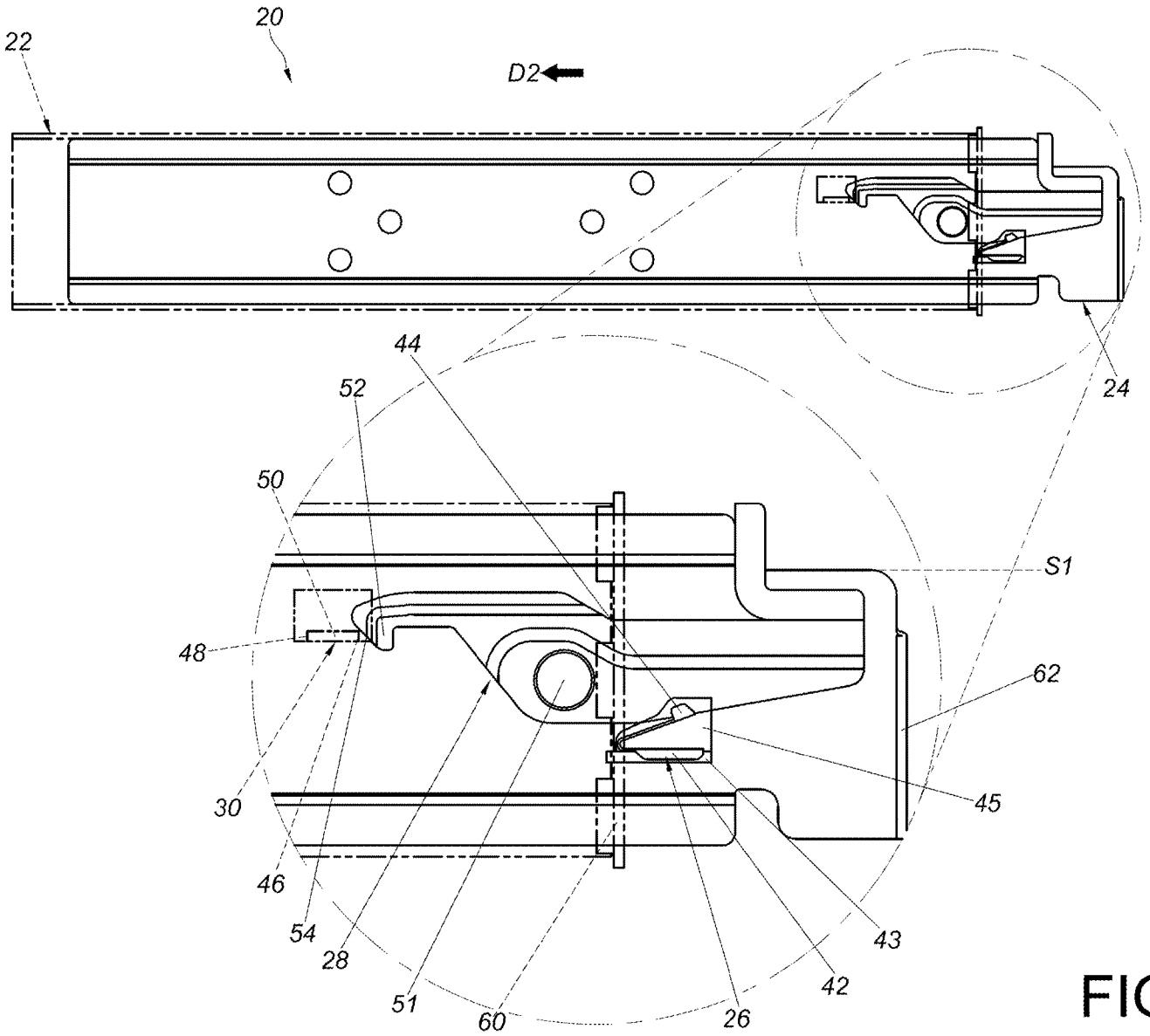
FIG. 7 is a diagram showing the second rail of the slide rail kit being moved relative to the first rail along a retracting direction according to the embodiment of the present invention.
Figure 8:
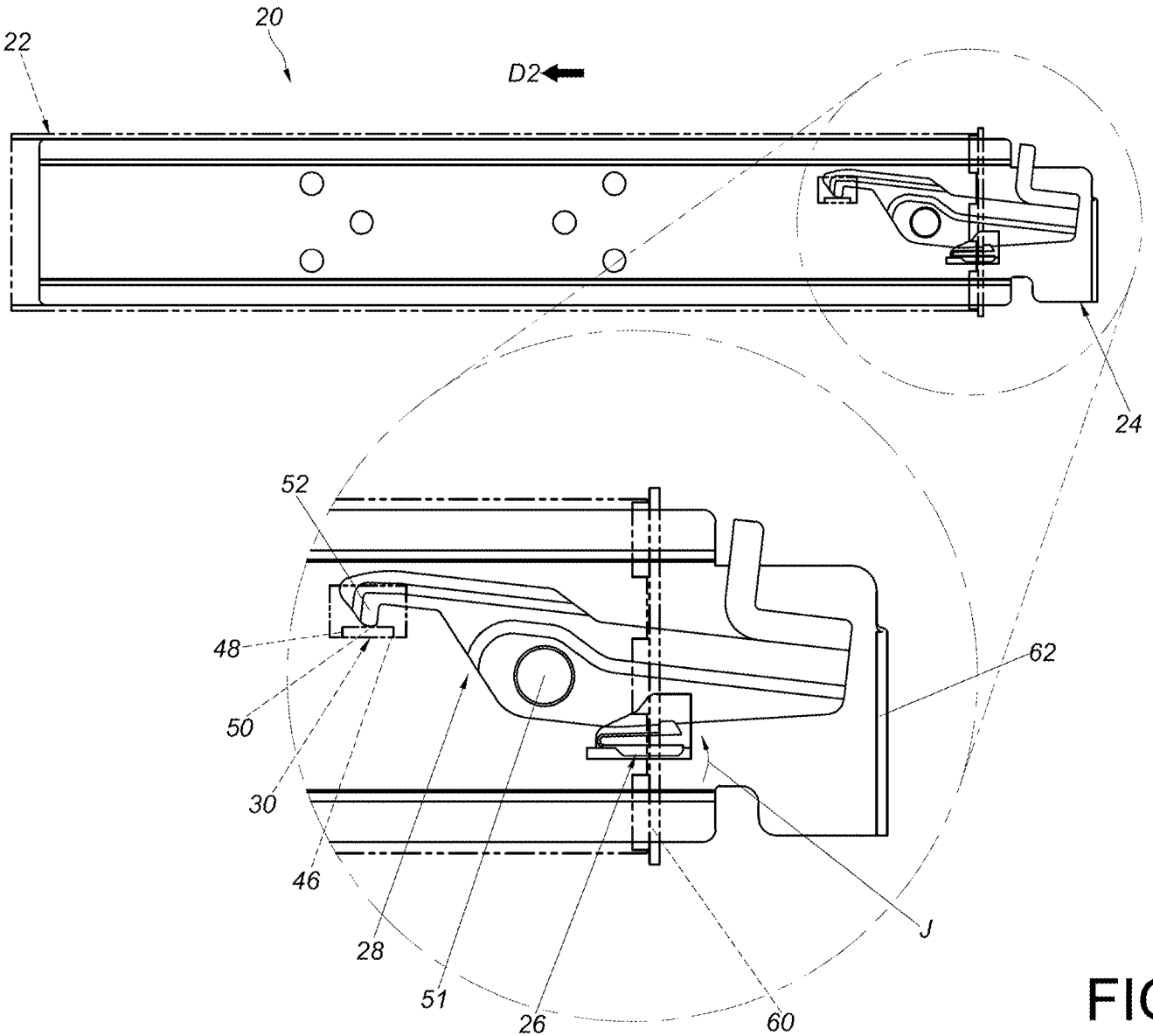
FIG. 8 is a diagram showing the second rail of the slide rail kit being further moved relative to the first rail along the retracting direction according to the embodiment of the present invention.

As shown in FIG. 7, FIG. 8 and FIG. 3, during a process of the second rail 24 being moved relative to the first rail 22 along a retracting direction D2 to the retracted position R, the guiding part 54 of the engaging member 28 is configured to abut against the first vertical wall 46 of the engaging feature 30 (as shown in FIG. 7) to be deflected by an angle to cross the first vertical wall 46 and further abut against the middle part 50, such that the elastic member 26 is configured to generate a predetermined elastic force J in response to deflection of the engaging member 28 (as shown in FIG. 8). When the engaging member 28 crosses the middle part 50 of the engaging feature 30, the elastic member is configured to release the predetermined elastic force J (as shown in FIG. 3), such that the engaging part 52 of the engaging member 28 is configured to abut against the second vertical wall 48 of the engaging feature 30 in order to lock the second rail 24 at the retracted position R relative to the first rail 22.

Figure 9:
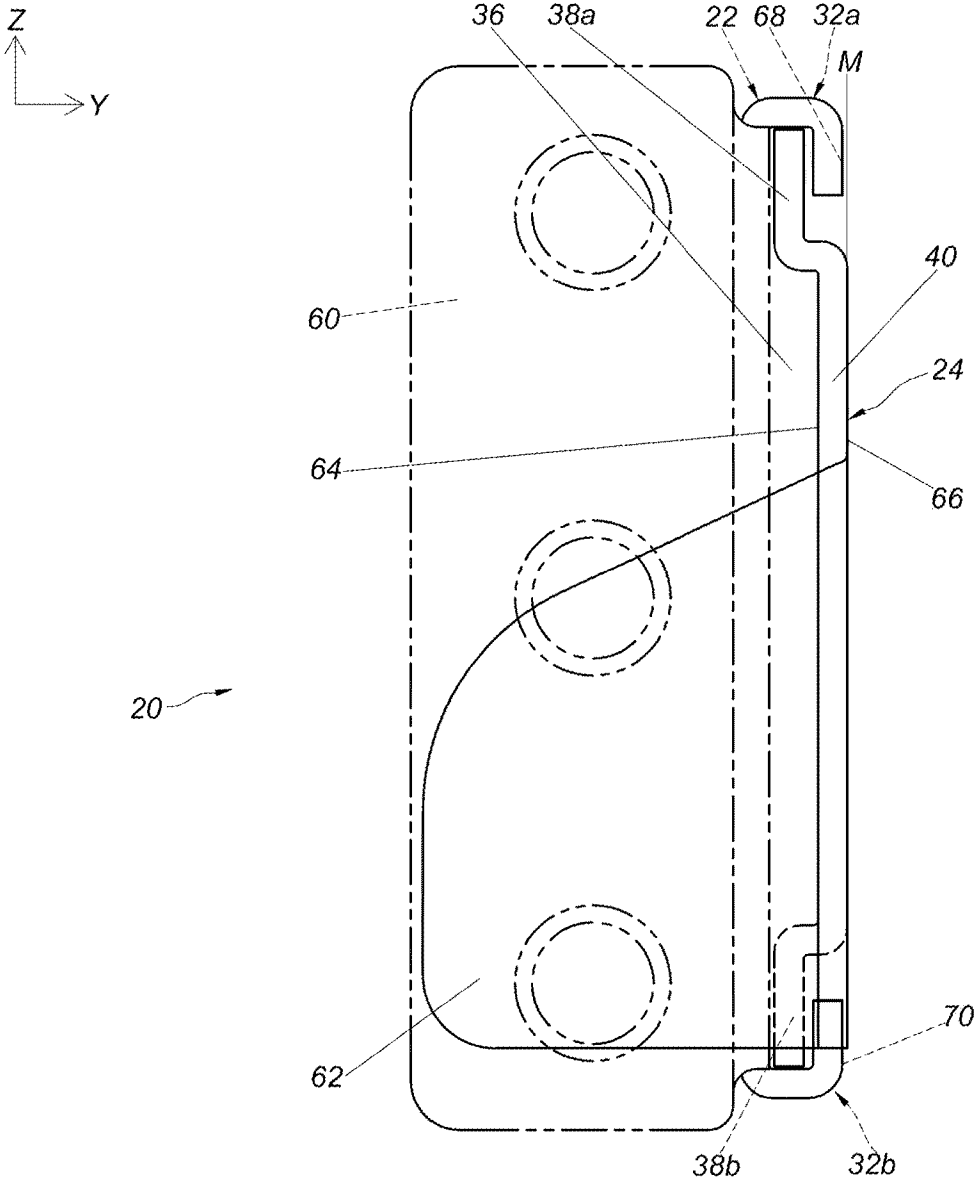
FIG. 9 is a cross-sectional view of the slide rail kit according to the embodiment of the present invention.

As shown in FIG. 9, the first wall 38*a* and the second wall 38*b* of the second rail 24 are supported by the first wall 32*a* and the second wall 32*b* of the first rail 22 respectively. The middle wall 40 of the second rail 24 and the first wall 32*a* and the second wall 32*b* of the first rail 22 are substantially located on a same plane M, so as to facilitate thinning of the slide rail kit 20. Furthermore, an upper part and a lower part of the middle wall 40 of the second rail 24 are respectively bent relative to the first wall 38*a* and the second wall 38*b* of the second rail 24. The middle wall 40 of the second rail 24 has an inner surface 64 and an outer surface 66 opposite to each other. The outer surface 66 of the middle wall 40 of the second rail 24 is substantially on the same plane M as a first wall surface 68 of the first wall 32*a* and a second wall surface 70 of the second wall 32*b* of the first rail 22, so as to facilitate thinning of the slide rail kit 20 in the transverse direction (or lateral direction).

Preferably, the engaging member 28 is movably mounted on the inner surface 64 of the middle wall 40 of the second rail 24 (please refer to FIG. 2).

Figure 10:
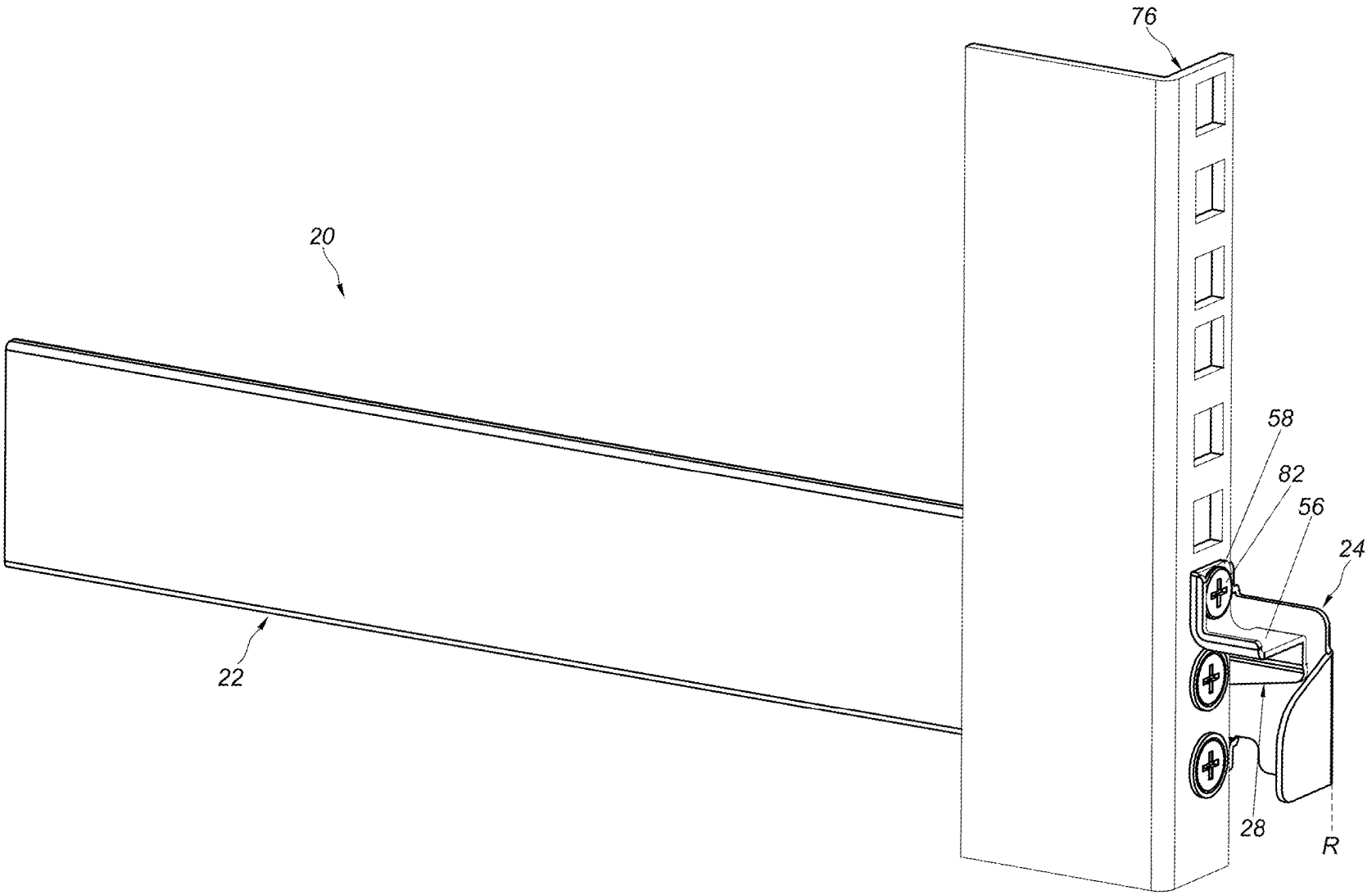
FIG. 10 is a diagram showing the slide rail kit being mounted to a rack according to the embodiment of the present invention.
Figure 11:
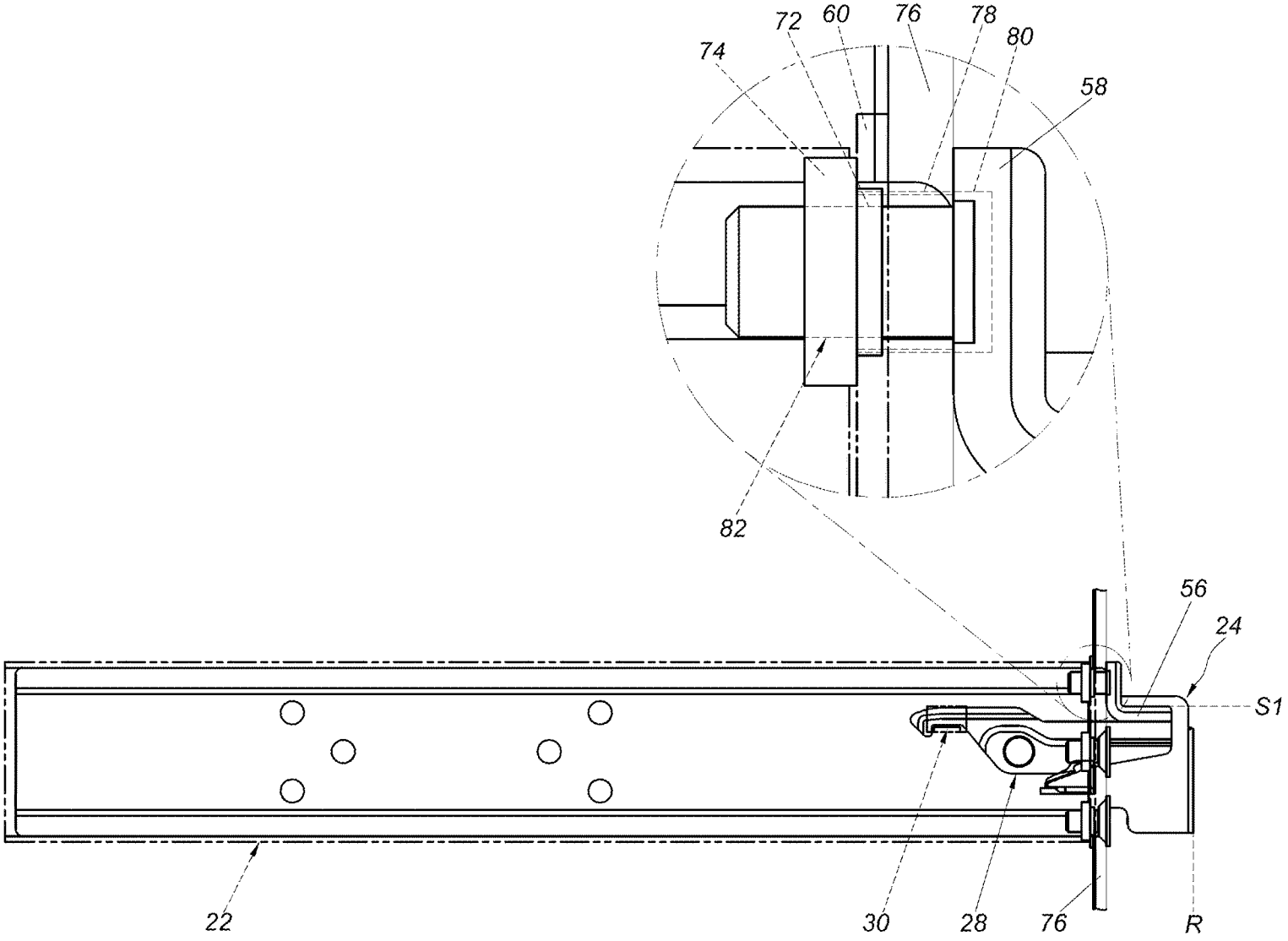
FIG. 11 is a diagram showing the slide rail kit being mounted to the rack according to the embodiment of the present invention.

As shown in FIG. 1, FIG. 10 and FIG. 11, the bending part 60 of the first rail 22 has a first mounting hole 72 and a screw base 74 corresponding to the mounting hole 72. Furthermore, the slide rail kit 20 is configured to be mounted to a rack 76 (or a post). The rack 76 has a second mounting hole 78. The connecting part 58 of the engaging member 28 has a predetermined hole 80 corresponding to the first mounting hole 72 and the second mounting hole 78.

Furthermore, when the second rail 24 is located at the retracted position R relative to the first rail 22, the user can insert a locking member 82 (such as a screw) into the predetermined hole 80, the second mounting hole 78 and the mounting hole 72 to fasten the locking member 82 to the screw base 74, such that the slide rail kit 20 can be fixed to the rack 76. Such configuration improves stability and safety of the second rail 24 carrying the carried object during transporting the rack 76.

Therefore, the slide rail kit 20 according to the embodiment of the present invention has the following technical features:

1. When the second rail 24 is located at the retracted position R relative to the first rail 22, the slide rail kit can provide a locking function.

2. A force F1 can be applied to the engaging member 28 to disengage the engaging member 28 from the first rail 22, and another force F2 can be further applied to the handle 62 of the second rail 24 to move the second rail 24 relative to the first rail 22 from the retracted position R along the opening direction D1. By using the handle 62, the user can easily apply the force to pull the second rail 24 out relative to the first rail 22 along the opening direction D1, or retract the second rail 24 along the retracting direction D2.

3. When the second rail 24 is located at the retracted position R relative to the first rail 22, the engaging member 28 is engaged with the engaging feature 30 of the first rail 22, such that the second rail 24 is locked at the retracted position R relative to the first rail 22. Moreover, by inserting the locking member 82 into the connecting part 58 (the predetermined hole 80 of the connecting part 58) and the bending part 60 (the first mounting hole 72 and the screw base 74 of the bending part 60), the second rail 24 can be more reliably held at the retracted position R relative to the first rail 22. Such configuration improves safety when transporting the slide rail kit 20. Or, when the second rail 24 is located at the retracted position R relative to the first rail 22, the user can fix the slide rail kit 20 to the rack 76 through the locking member 82 (as shown in FIG. 10 or FIG. 11), such that the second rail 24 is held at the retracted position R relative to the first rail 22. Such configuration improves stability and safety of the second rail 24 carrying the carried object during transporting the rack 76.

4. The outer surface 66 of the middle wall 40 of the second rail 24 is substantially on the same plane M as the first wall surface 68 of the first wall 32*a* and the second wall surface 70 of the second wall 32*b* of the first rail 22, so as to facilitate thinning of the slide rail kit 20.

5. The middle wall 40 of the second rail 24 has an opening 45 (as shown in FIG. 2). The elastic member 26 is configured to be mounted inside the opening 45, so as to reduce the space occupied by the elastic member 26 at both sides of the second rail 24.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail kit, comprising:

a first rail arranged with an engaging feature;

a second rail movable relative to the first rail;

an elastic member; and an engaging member movably mounted on the second rail and adjacent to a front end of the second rail, the engaging member configured to be held in an engaging state in response to an elastic force of the elastic member;

wherein when the second rail is located at a retracted position relative to the first rail, the engaging member is configured to be engaged with the engaging feature of the first rail, in order to lock the second rail at the retracted position relative to the first rail;

wherein when a force is applied to the engaging member to overcome the elastic force of the elastic member, the engaging member is configured to be moved to switch from the engaging state to a disengaging state, in order to allow the second rail to move relative to the first rail from the retracted position along an opening direction;

wherein the engaging feature comprises a first vertical wall, a second vertical wall, and a middle part connected between the first vertical wall and the second vertical wall, and the engaging member comprises a guiding part and an engaging part; wherein during a process of the second rail being moved relative to the first rail along a retracting direction to the retracted position, the guiding part of the engaging member is configured to abut against the first vertical wall of the engaging feature to be deflected by an angle to cross the first vertical wall and further abut against the middle part, such that the elastic member is configured to generate a predetermined elastic force in response to deflection of the engaging member; when the engaging member crosses the middle part, the elastic member is configured to release the predetermined elastic force, such that the engaging part of the engaging member is configured to abut against the second vertical wall of the engaging feature in order to lock the second rail at the retracted position relative to the first rail.

2. The slide rail kit of claim 1, wherein the first rail comprises a first wall, a second wall and a middle wall connected between the first wall and the second wall of the first rail, a passage is defined by the first wall, the second wall and the middle wall and configured to mount the second rail, and the engaging feature is located inside the passage of the first rail.

3. The slide rail kit of claim 2, wherein the second rail comprises a first wall, a second wall and a middle wall connected between the first wall and the second wall of the second rail, the elastic member is arranged on the middle wall of the second rail, the elastic member is a V-shaped elastic piece, and the elastic member comprises a first elastic arm abutting against a predetermined mounting part of the middle wall of the second rail, and a second elastic arm configured to support the engaging member.

4. The slide rail kit of claim 3, wherein the first wall and the second wall of the second rail are respectively supported by the first wall and the second wall of the first rail, and the middle wall of the second rail and the first wall and the second wall of the first rail are substantially located on a same plane.

5. The slide rail kit of claim 4, wherein the engaging member is movably mounted on the middle wall of the second rail.

6. The slide rail kit of claim 5, wherein the engaging member is pivotally connected to the second rail.

7. The slide rail kit of claim 1, wherein a bending part is perpendicularly connected to a front end of the first rail, the bending part has a mounting hole and a screw base corresponding to the mounting hole, the engaging member further comprises an operating part and a connecting part perpendicularly connected to the operating part, and the connecting part has a predetermined hole corresponding to the mounting hole.

8. The slide rail kit of claim 7, wherein a bending section is perpendicularly connected to a front end of the second rail; wherein when the second rail is locked at the retracted position relative to the first rail, a predetermined space is defined between the bending section of the second rail and the bending part of the first rail.

9. The slide rail kit of claim 8, wherein when the force is applied to the operating part, the engaging member is configured to be moved to switch from the engaging state to the disengaging state, and when another force is further applied to the bending section along the opening direction, the second rail is configured to be moved relative to the first rail from the retracted position along the opening direction.

10. A slide rail kit, comprising:

a first rail arranged with an engaging feature;

a second rail movable relative to the first rail;

an elastic member; and an engaging member movably mounted on the second rail, the engaging member configured to be held in an engaging state in response to an elastic force of the elastic member;

wherein when the second rail is located at a retracted position relative to the first rail, the engaging member is configured to be engaged with the engaging feature of the first rail, in order to lock the second rail at the retracted position relative to the first rail;

wherein the engaging member comprises an operating part;

wherein the second rail is arranged with a handle;

wherein when a force is applied to the operating part, the engaging member is configured to be moved to switch from the engaging state to a disengaging state, in order to disengage the engaging member from the engaging feature of the first rail, and when another force is further applied to the handle along an opening direction, the second rail is configured to be moved relative to the first rail from the retracted position along the opening direction.

11. The slide rail kit of claim 10, wherein a front end of the first rail is arranged with a bending part, the bending part has a mounting hole and a screw base corresponding to the mounting hole, the engaging member further comprises a connecting part bent relative to the operating part, and the connecting part has a predetermined hole corresponding to the mounting hole.

12. The slide rail kit of claim 10, wherein the first rail comprises a first wall, a second wall and a middle wall connected between the first wall and the second wall of the first rail, a passage is defined by the first wall, the second wall and the middle wall and configured to mount the second rail, and the engaging feature is located inside the passage of the first rail.

13. The slide rail kit of claim 12, wherein the second rail comprises a first wall, a second wall and a middle wall connected between the first wall and the second wall of the second rail, the elastic member is arranged on the middle wall of the second rail, the elastic member is a V-shaped elastic piece, and the elastic member comprises a first elastic arm abutting against a predetermined mounting part of the middle wall of the second rail, and a second elastic arm configured to support the engaging member.

14. The slide rail kit of claim 13, wherein the first wall and the second wall of the second rail are respectively supported by the first wall and the second wall of the first rail.

15. The slide rail kit of claim 14, wherein an upper part and a lower part of the middle wall of the second rail are respectively bent relative to the first wall and the second wall of the second rail, the middle wall of the second rail has an inner surface and an outer surface opposite to each other, and the middle wall of the second rail and the first wall and the second wall of the first rail are substantially located on a same plane.

16. The slide rail kit of claim 15, wherein the engaging member is movably mounted on the inner surface of the middle wall of the second rail.

17. The slide rail kit of claim 10, wherein the engaging feature comprises a first vertical wall, a second vertical wall, and a middle part connected between the first vertical wall and the second vertical wall, and the engaging member further comprises a guiding part and an engaging part; wherein during a process of the second rail being moved relative to the first rail along a retracting direction to the retracted position, the guiding part of the engaging member is configured to abut against the first vertical wall of the engaging feature to be deflected by an angle to cross the first vertical wall and further abut against the middle part, such that the elastic member is configured to generate a predetermined elastic force in response to deflection of the engaging member; when the engaging member crosses the middle part, the elastic member is configured to release the predetermined elastic force, such that the engaging part of the engaging member is configured to abut against the second vertical wall of the engaging feature in order to lock the second rail at the retracted position relative to the first rail.

18. The slide rail kit of claim 17, wherein the handle is a bending section adjacent to a front end of the second rail; wherein when the second rail is locked at the retracted position relative to the first rail, a predetermined space is defined between the handle of the second rail and the bending part of the first rail.

19. The slide rail kit of claim 18, wherein the handle is substantially perpendicularly connected to the front end of the second rail.

* * * * *